United States Patent [19]

Excellente

[11] Patent Number: 4,635,522

[45] Date of Patent: Jan. 13, 1987

[54] ASYMMETRIC STRINGED INSTRUMENT

[76] Inventor: Richard Excellente, 1018 Brighton St., Union, N.J. 07083

[21] Appl. No.: 846,016

[22] Filed: Mar. 31, 1986

[51] Int. Cl.[4] ..... G10D 1/08

[52] U.S. Cl. ..... 84/291; 84/267

[58] Field of Search ..... 84/1.16, 267, 290–293

[56] References Cited

U.S. PATENT DOCUMENTS 3,482,028 12/1969 Cox et al. ..... 84/1.16

4,359,923 11/1982 Brunet ..... 84/267

4,539,886 9/1985 Hoffart ..... 84/267

*Primary Examiner*—Lawrence R. Franklin

*Attorney, Agent, or Firm*—Omri M. Behr

[57] ABSTRACT

The tonal body disparity between low and high frequency in a stringed instrument and the like may be balanced out by building the guitar having unsymmetrical mass loading wherein a larger mass is provided to the side of the guitar having strings of high frequency then to the other side. This may be achieved by actual peripherally mass loading a conventional guitar, building a guitar with a cross-section substantially resembling a tear-drop, said cross-section being taken in a plane substantially perpendicular to the upper surface of the guitar and equally perpendicular to the principal longitudinal axis of the neck of the guitar or a combination thereof.

28 Claims, 6 Drawing Figures

ASYMMETRIC STRINGED INSTRUMENT

BACKGROUND OF THE INVENTION

It is well known that in guitars, particularly electric guitars which may have solid or hollow bodies, that the quality of the tone produced by the low frequency strings is superior to that produced by the high frequency strings. In conventional electric guitars low frequency strings are generally of substantially greater density per unit length than high frequency strings. Heretofore, it has not been possible to equalize the tone quality of the strings while maintaining the other desired qualities of pitch, ease of playing, and the like. The purpose of the present invention is to provide a guitar of such qualities.

It is the surprising finding of the present invention that this problem may be solved by building the guitar with a rigid unsymmetrical mass loading wherein a larger mass is provided to the side of the guitar proximal to strings of high frequency then to the other side. This may be achieved by actually peripherally mass loading a conventional guitar, building a guitar with a crosssection substantially resembling a tear-drop, the narrow portion of the tear-drop being proximal to the strings of lowest frequency, said cross-section being taken in a plane substantially perpendicular to the upper surface of the guitar and perpendicular to the principal longitudinal axis of the neck of the guitar or a combination thereof.

Heretofore, rigid metallic frames have been clamped or rigidly affixed around the entire edge of a guitar in order to enhance the general sound effect. Unsymmetrical placement of such frames however is not known.

Guitars of this design are not known. A guitar which superficially appears to have such a cross-section is disclosed in U.S. Pat. No. Des. 263,601 to Klein. The guitar, viewed in plan, has a substantially axe-shaped appearance. Upon close inspection however, it is noted that the two ends of the axe shaped portion appear to be purely decorative. It is further to be noted that that portion of the Klein guitar with the narrowest crosssection appears to be downwardly directed (i.e., proximal to the strings of highest frequency) in the playing position. The sound box appears to be conventional and of rectangular cross-section.

U.S. Pat. No. 3,426,638 to W. E. Smith discloses a guitar having two embodiments. In one embodiment there is provided a substantially conventional guitar body; however, the fret board carrying the strings is mounted on a wedge shaped neck. The purpose and effect of this wedge is to enable the guitar to be played with the strings in a substantially horizontal plane. In another modification of Smith's invention, the neck strings and fret board lie substantially in the same plane as the upper surface of the guitar. However, a wedge is provided to the bottom surface of the otherwise substantially conventional guitar which in turn serves to enable a conventional guitar to be played in a similar manner.

It should be noted that in the second Smith embodiment the sound box is still substantially rectangular in cross section in the conventional manner. Neither Smith nor Klein make any mention of any changes in tone or quality of any of the strings as a result of their novel structures.

SUMMARY OF THE INVENTION

It is the surprising finding of the present invention that the resonant qualities of the strings of higher frequency in stringed instruments can be substantially improved by a rigid unsymmetrical mass loading proximal to the strings of high frequency. This may be achieved by providing a rigid metallic rim whose weight distribution is greater proximal to said strings. Thus, the added loading having a weight of about 10% to about 40% of the weight of the unloaded instrument is located on the side proximal to the strings of high frequency. The invention is operative at lower or higher loadings, however, at lower loadings the effect is very slight and at higher loadings the physical balance of the instrument is disturbed in such a manner as to make it difficult to hold and play in the conventional manner.

Alternatively, the problem may be solved by constructing a guitar or similar stringed instrument having a substantially tear-drop cross-section and locating the strings of high frequency on the fret board in the conventional manner so that the "fatter" side of the body is proximal to the said strings of higher frequency and the "thinner" side of the body is proximal to the strings of lower frequency, or a combination of both approaches. In one embodiment the loading is achieved by providing a rigid metal frame at least to the bottom of said body which is unsymmetrically loaded with the greater mass on the side proximal to the high frequency strings.

DETAILED DESCRIPTION OF THE DRAWINGS

Figure 1:
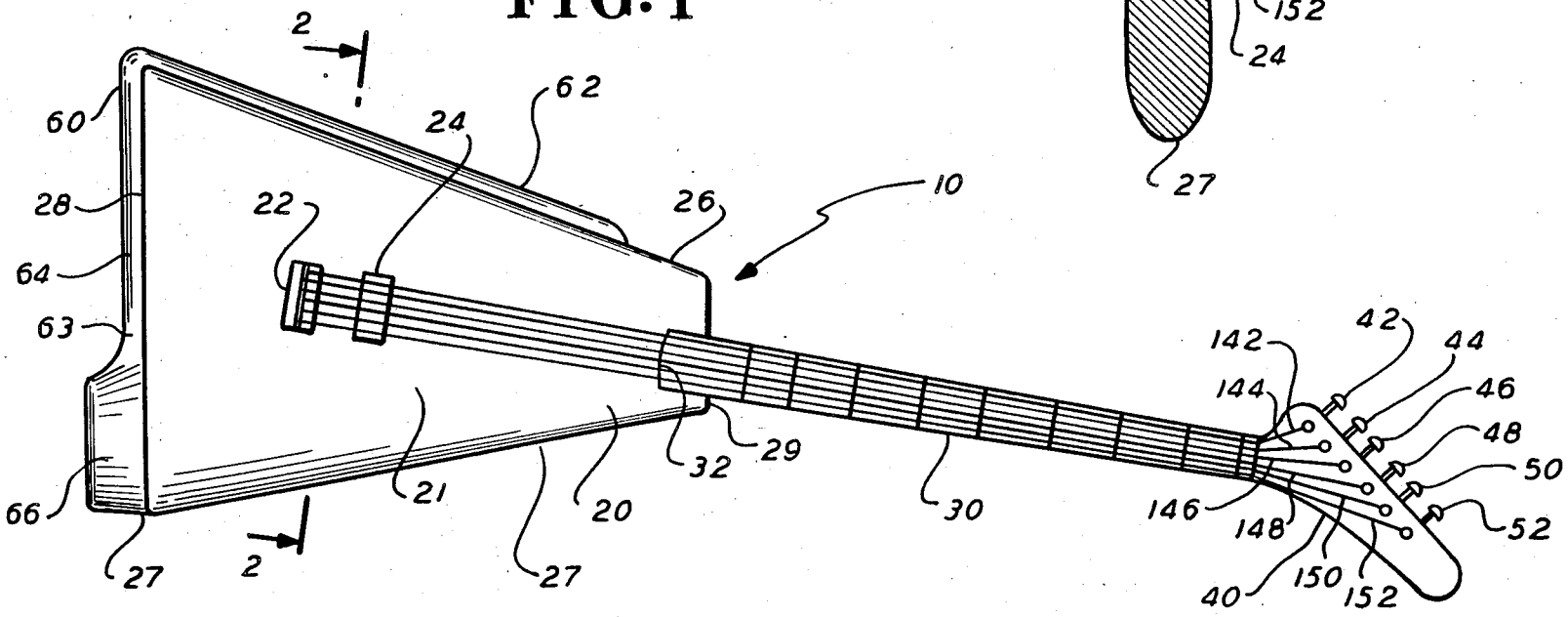
FIG. 1 is a plan view of an embodiment of the novel guitar of the present invention.

The guitar generally designated as 10 is illustrated in FIG. 1. The guitar, as is conventional, comprises a body section 20 having attached thereto a neck 30 to the upper end of which is connected tuning head 40. Body 20 may be constructed, in plan, to substantially any design which is deemed desirable from an esthetic point of view. The tetrahedral-like shape shown is purely illustrative of possible designs.

Figure 2:
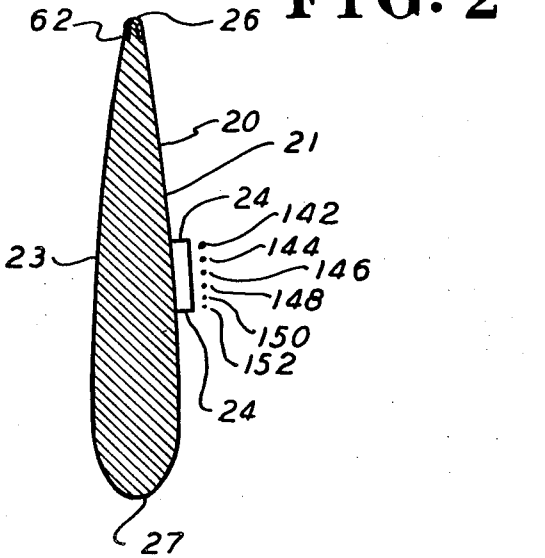
FIG. 2 is a cross-sectional view of the guitar viewed at 2—2 of FIG. 1.

For purposes of convenience the body is designated as having four edges, an upper edge 29, a lower edge 28, and two side edges 27 and 26. The body has an upper surface 21 and a lower surface 23. As illustrated in FIG. 2, the body has a substantially tear-dropped cross-section.

At least the upper surface 21 is shallowly convex. If considered as substantially, though not absolutely, planar, upper and lower surfaces 21 and 23 subtend an angle of about 10° to about 30° to each other and are connected by a narrow edge surface 26 of a radius which is substantially smaller than that of corresponding wide edge surface 27.

The remaining portion of the guitar is constructed in a substantially conventional manner. Body 20 carries a block 22 and a bridge 24. End 32 of neck 30 is attached to body 20 proximate to upper edge 29. String tightening units 42, 44, 46, 48, 50 and 52 are embedded in tuning head 40. Strings 142, 144, 146, 148, 150 and 152 are attached at one end thereof to string tightening units 42, 44, 46, 48, 50 and 52 respectively. The lower ends of said strings passes over bridge 24 and are attached to block 22 in the conventional manner. While the illustrated embodiment shows 6 strings, guitars with 4, 10 and 12 strings are known and may be used. An amplifying unit, not shown, may be placed on or in the guitar in the usual manner.

The unsymmetrical peripheral loading may alternatively be provided by a rigid frame around the edges of the guitar. The guitar may either be of conventional cross-section, i.e., substantially rectangular or as illustrated above. While the principal effect achieved by the present invention is most notable in electric guitars wherein the body 20 is of solid construction, the invention is not limited thereto and body 20 may be partially or completely hollow. It will be understood by those skilled in the art that substantial variations are possible in the actual radii of curvature of edge 26 and edge 27. Furthermore, variations are also to be expected in the approximate angle subtended at edge 26 between surfaces 21 and 23.

In guitar construction, the bridge 22, with some variation in exact placement, is located substantially midway between edges 26 and 27. It is a basic characteristic of the present invention that the mass of the guitar body 22 shall be greater on the side thereof proximate to edge 27 than on the side thereof proximate to edge 26. This is so whether provided by the structure of the body, by the frame portion 60 or a combination thereof.

In the conventional construction of guitars and similar stringed instruments, the strings of higher pitch are located on the right-hand side of the bridge (as viewed in downward plan) and the strings of lower pitch are located on the left-hand side of the bridge.

Where additional loading is provided to the guitar body, there is provided a rigid metal frame 60 which, in the preferred embodiment, has a narrow edge segment 62 running substantially the entire length of edge 26. The metal frame 60 is rigidly fixed to the edge of the instrument. Any rigid metal may be utilized. Aluminum and steel are suitable; however, aluminum is to be preferred since it is more readily molded into the shapes required and, in the proportions shown in the drawing, provide adequate weight loading while meeting esthetic considerations of appearance of the instrument. Whether or not it runs the entire length or a major portion of the length is a matter of esthetic choice. A further part of frame 60 is bottom edge segment 63 which similarly encompasses either the major part or all of the bottom edge 28. In the especially preferred embodiment as illustrated, segment 63 comprises a lighter segment 64 proximate to narrow edge segment 62 and heavier portion 66 proximate to the junction of bottom edge 28 with wide edge 27. It is entirely within the scope of the present invention to place all of the increased mass along edge 27 if so desired and if a proper balance of the instrument can still be maintained thereby. It will be clear to those skilled in the art that the placement of loading strip 62 along edge 26 is principally a matter of esthetics and helps to hold the loading portion 63 and 66 in place on the bottom edge 28 of the instrument. The actual mass loading of portion 62 should be held to a minimum since, as stated previously, this loading adds to the "low frequency" side of the instrument, whereas the purpose of the invention is to load the "high frequency" side of the instrument.

In yet further embodiments of the invention, in order to obtain extraordinary and unusual tonal effects other than those contemplated by the principal purpose of the present invention, the heavier weight of bottom edge segment 63 may be shifted to lie at various predetermined positions along bottom edge 28.

Figure 3:
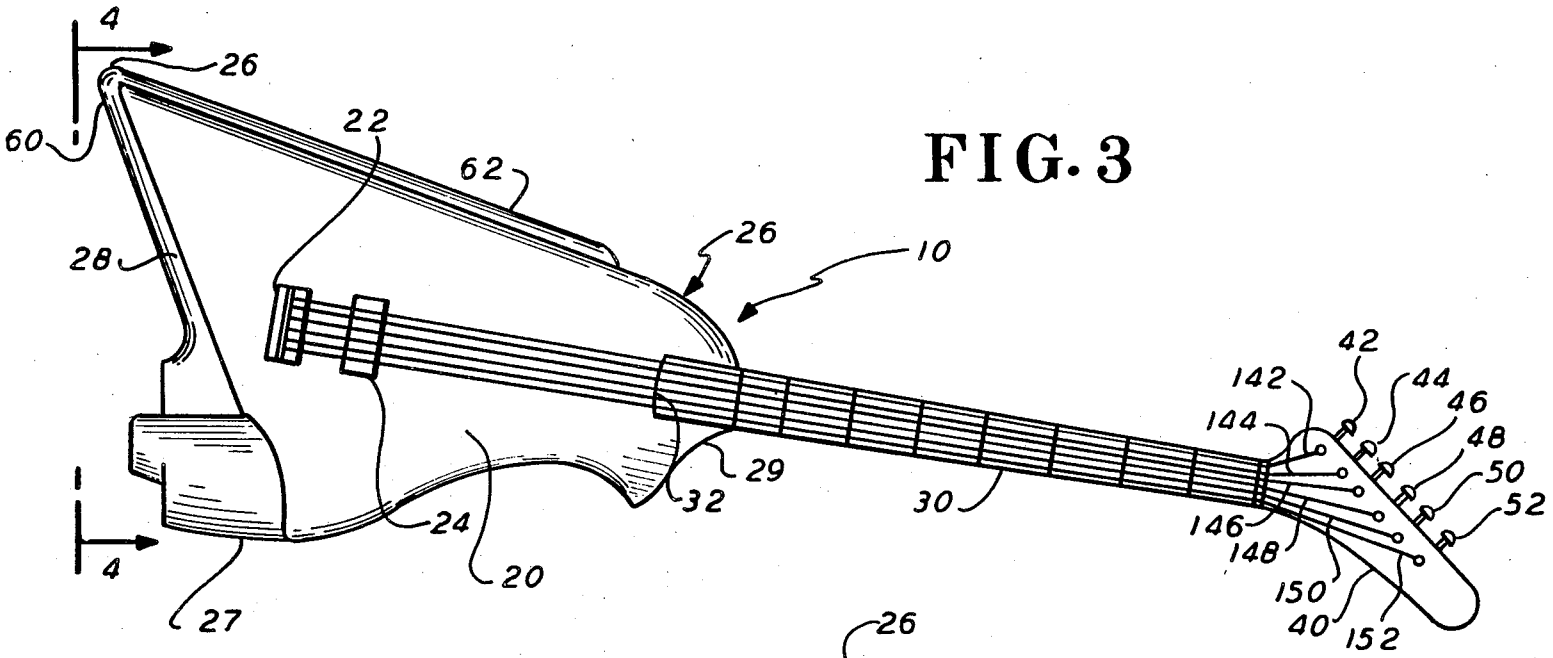
FIG. 3 is a plan view of another embodiment of the novel guitar of the present invention.
Figure 4:
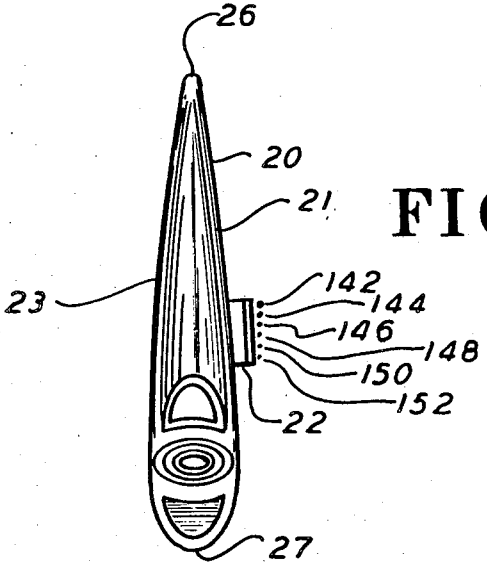
FIG. 4 is an upward elevational view of the bottom edge of the guitar viewed at 4—4 of FIG. 3.

FIGS. 3 and 4 illustrate a particular embodiment of the invention. All numbers are the same as in FIGS. 1 and 2. The drawings merely illustrate the body and frame segment in different shapes. The functions are the same as in FIGS. 1 and 2.

Figure 6:
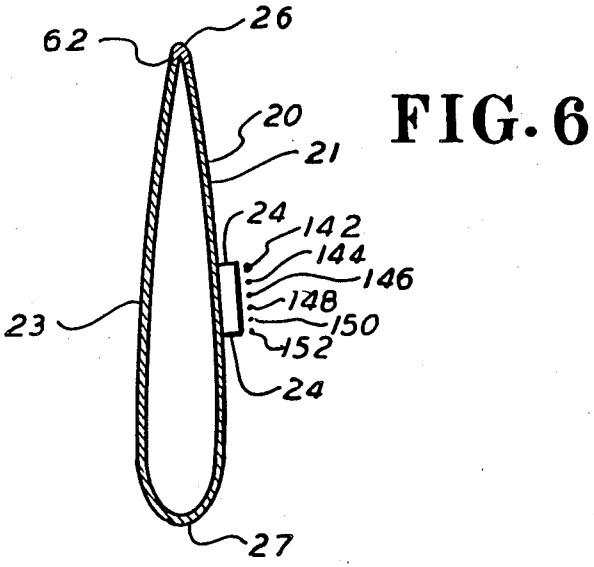
FIG. 6 is a cross sectional view of the guitar viewed at 6—6 of FIG. 5.
Figure 5:
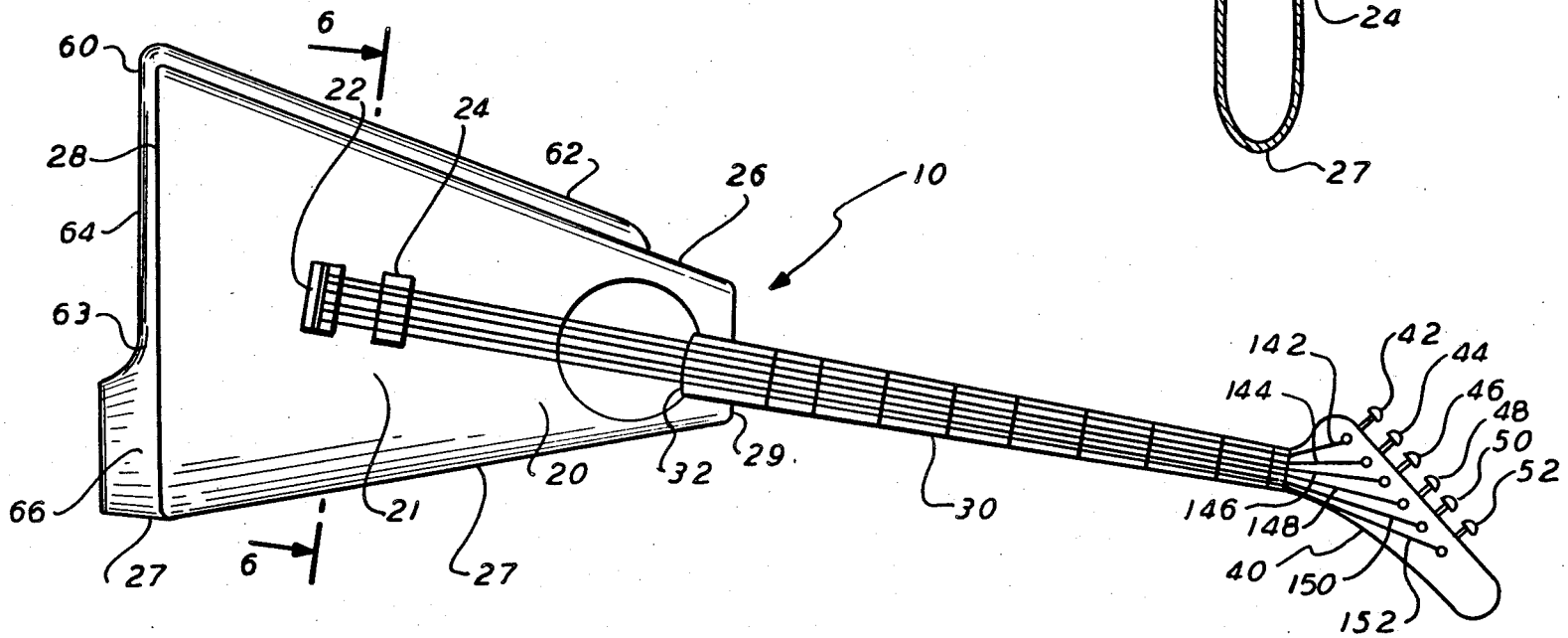
FIG. 5 is a plan view of a hollow embodiment of a novel guitar of the present invention.

FIGS. 5 and 6 illustrate an acoustic, that is to say, hollow guitar which otherwise is constructed in a manner substantially similar to that illustrated in FIG. 1. All numbers are the same as in FIGS. 1 and 2 since the items on the instrument are otherwise the same.

The effect of shifting the weight on bottom edge 28 of the instrument towards edge 26 away from edge 27 would be to accentuate the tonal imbalance whereby the low frequency strings have a fuller tone than the high frequency strings. While under most circumstances this is generally considered to be an undesirable effect, certain musicians may intend such deliberate distortions in order to achieve tonal effects which they personally desire.

The pitch of the strings may be determined either by the density per unit length of the string or by the tension placed upon it, or a combination thereof. Thus, it is entirely possible to utilize strings of equal diameter and obtain the conventional one octave spread of basic frequency purely by means of adjusting the tension on the strings. This procedure however is not usual since it in fact involves under-tensioning the strings of the lowest frequency and over -tensioning the strings of the highest frequency. It is more conventional to utilize high density strings in, for example, position 142 and low density strings in position 152. The materials utilized for the strings may vary but in electric guitars a coiled coil spring type of string is used in position 142 and a single comparatively low diameter wire is used in position 152.

It will be seen that while the placement of an unsymmetrical frame will enhance the field density effect of a guitar of cross-sections illustrated in FIG. 2, such an effect may be equally achieved by placing an unsymmetrical frame around a guitar of conventional, i.e., substantially rectangular cross section.

While the illustrated examples in the present specification is a guitar, the invention and its principles are not so limited. The invention is intended to include all stringed instruments having strings which are plucked or stroked and laid across a sounding board or body. Thus, for purposes of illustrating but not limitation, there may be mentioned violins, violas, cellos, basses, double basses, banjos, ukeleles, zithers, and the like.

What is claimed is:

1. In a stringed instrument comprising a body having a front surface and a rear surface, peripheral edges connecting said front and rear surfaces, a neck extending from one end of said body, and strings tensioned on the body and the neck in a substantially common plane, the improvement comprising a rigid metallic frame affixed to a portion of said peripheral edges in such a manner that the resultant mass of the side thereof proximal to the strings of highest frequency is greater than that on the other side distal to said strings of highest frequency by between 10% and 40% of the weight of the instrument prior to said affixation upon the peripheral edges of the instrument.

2. An instrument of claim 1 wherein said instrument is a guitar.

3. In a stringed instrument comprising a body having a front surface and a rear surface, peripheral edges joining said surfaces, a neck extending from one end of said body, and strings tensioned on the body and the neck in a substantially common plane, the improvement wherein said body has a substantially tear-drop cross-section taken perpendicular to the plane of said neck and the principal longitudinal axis of said neck wherein the portion of the peripheral edge on the side of the instrument proximal to the strings of lower frequency between said front surface and said rear surface tapers to a radius substantially smaller than the radius of the taper on the portion of the edge thereof between said front surface and said rear surface proximal to the strings of higher frequency.

4. An instrument of claim 3 wherein said instrument is a guitar.

5. An instrument of claim 3 having at least four strings, at least one of said strings being of greater density per unit length then at least one of said other strings.

6. An instrument of claim 5 wherein said instrument is a guitar.

7. An instrument 5 wherein the string of greatest density is located on the side of the neck proximal to the portion of the edge having the least radius and the string of least density per unit length being located proximal to the portion of the edge having the greatest radius.

8. An instrument of claim 7 wherein said instrument is a guitar.

9. An instrument of claim 7 wherein several strings of different densities per unit length are utilized and placed on the neck, said strings being arranged so that the strings tuned to vibrate to the lowest frequency are placed proximal to the edge of the least radius and the strings tuned to vibrate to the highest frequency are placed proximal to the edge of greatest radius.

10. An instrument of claim 9 wherein said instrument is a guitar.

11. An instrument of claim 3 wherein the body is solid.

12. An instrument of claim 11 wherein said instrument is a guitar.

13. An instrument of claim 3 wherein the body is substantially hollow.

14. An instrument of claim 13 wherein said instrument is a guitar.

15. In a stringed instrument comprising a body having a front surface and a rear surface, peripheral edges joining said surfaces, a neck extending from one end of said body, and strings tensioned on the body and the neck in a substantially common plane, the improvement wherein said body has a substantially tear-drop cross-section taken perpendicular to the plane of said neck and the principal longitudinal axis of said neck wherein the portion of the peripheral edge on the side of the instrument proximal to the strings of lower frequency between said front surface and said rear surface tapers to a radius substantially smaller than the radius of the taper on the portion of the edge thereof between said front surface and said rear surface proximal to the strings of higher frequency, additionally comprising a rigid metallic frame affixed to a portion of said peripheral edges in such a manner that the resultant mass of the side thereof proximal to the strings of highest frequency is greater than that on the other side distal to said strings of highest frequency by between 10% and 40% of the weight of the instrument prior to said affixation upon the peripheral edges of the instrument.

16. An instrument of claim 15 wherein said instrument is a guitar.

17. An instrument of claim 15 wherein rigid metal rim is placed on the portion of the edge of least radius and the portion of the edge of the body adjacent thereto and distal to the neck.

18. An instrument of claim 17 wherein said instrument is a guitar.

19. An instrument of claim 17 wherein the metal frame on the portion of the edge of the body distal to the neck has an unequal distribution of weight between the ends thereof.

20. An instrument of claim 19 wherein said instrument is a guitar.

21. An instrument of claim 19 wherein the weight distribution of the frame on the edge portion distal to the neck is least proximate to the edge portion of least radius and greatest proximate to the edge portion of greatest radius.

22. An instrument of claim 21 wherein said instrument is a guitar.

23. An instrument of claim 15 wherein a rigid metal rim encompasses a major portion of the edge portion of greatest radius.

24. An instrument of claim 23 wherein said instrument is a guitar.

25. An instrument in accordance with claim 3 wherein the said front surface is shallowly convex.

26. An instrument in accordance with claim 25 wherein the instrument is a guitar.

27. In a stringed instrument comprising a body having a front surface and a rear surface, peripheral edges joining said surfaces, a neck extending from one end of said body, and strings tensioned on the body and the neck in a substantially common plane, the improvement comprising a rigid metallic frame affixed to a portion of said peripheral edges in such a manner that the resultant mass of the side thereof proximal to the strings of highest frequency is greater than that on the other side distal to said strings of highest frequency by about at least 10% of the weight of the instrument prior to said affixation upon the peripheral edges of the instrument.

28. In a stringed instrument comprising a body having a front surface and a rear surface, peripheral edges joining said surfaces, a neck extending from one end of said body, and strings tensioned on the body and the neck in a substantially common plane, the improvement wherein said body has a substantially tear-drop cross-section taken perpendicular to the plane of said neck and the principal longitudinal axis of said neck wherein the portion of the peripheral edge on the side of the instrument proximal to the strings of lower frequency between said front surface and said rear surface tapers to a radius substantially smaller than the radius of the taper on the portion of the edge thereof between said front surface and said rear surface proximal to the strings of higher frequency, additionally comprising a rigid metallic frame affixed to a portion of said peripheral edges in such a manner that the resultant mass of the side thereof proximal to the strings of highest frequency is greater than that on the other side distal to said strings of highest frequency by about at least 10% of the weight of the instrument prior to said affixation upon the peripheral edges of the instrument.

* * * * *